252-99 AU 165 EX
5/3/77 OR 4,021,360

United States Patent [19]

McLaughlin et al.

[11] 4,021,360

[45] May 3, 1977

[54] POWDER DETERGENT COMPOSITIONS

[75] Inventors: Robert L. McLaughlin, Wilmette; Donald C. Wood, Des Plaines, both of Ill.

[73] Assignee: DeSoto, Inc., Des Plaines, Ill.

[22] Filed: Oct. 15, 1975

[21] Appl. No.: 622,622

[52] U.S. Cl. ..... 252/99; 252/95; 252/135

[51] Int. Cl.[2] ..... C11D 7/56

[58] Field of Search ..... 252/99, 95, 135

[56] References Cited

UNITED STATES PATENTS

| | | | |
|---|---|---|---|
| 3,549,539 | 12/1970 | Mallows | 252/99 |
| 3,696,041 | 10/1972 | Gray | 252/99 |
| 3,846,325 | 11/1974 | Flynn | 252/99 |

OTHER PUBLICATIONS

"Sodium Phosphates" Monsanto, Sept. 1961, pp. 10 & 11, 19.

*Primary Examiner*—Mayer Weinblatt
*Attorney, Agent, or Firm*—Dressler, Goldsmith, Clement, Gordon & Shore, Ltd.

[57] ABSTRACT

Powder detergent compositions for machine dish washing which are effective in hard water in the absence of large amounts of phosphates are provided based on a combination of low foaming nonionic surfactant, bleaching agent, alkali metal hexametaphosphate, and from 15–70% of borax. The composition is buffered to provide a pH in the range of pH 7.0 to pH 8.5 measured in 1% water solution.

18 Claims, No Drawings

POWDER DETERGENT COMPOSITIONS

The present invention relates to powder detergent compositions adapted for machine dish washing and which are effective in hard water. These compositions are significant in that they exhibit superior performance despite the presence of very little phosphate therein.

Detergent compositions in powder form and which are adapted for machine dish washing are usually based on the presence of a large proportion of a phosphate component and frequently possess considerable alkalinity providing a pH above 8.5. This invention is concerned with providing a powder detergent composition which exhibits a pH not in excess of pH 8.5 and which does not require the presence of any large proportion of phosphate component or any sequestering agent, but which is nonetheless capable of removing foods and leaving the dishes and glasses unspotted while being safe for the dishes which are washed.

In accordance with this invention, a powder detergent composition which requires the presence of very little phosphate and which does not need sequestering agents, but which is effective at a pH in the range of pH 7.0 to pH 8.5 (measured in 1% water solution), consists essentially of the following components by weight:

1. from 2–8% of low foaming nonionic surfactant useful for machine dish washing.
2. from 0.5–5% of available chlorine or oxygen from a bleaching agent,
3. from 15–70% of borax,
4. alkali metal (typically sodium) hexametaphosphate in an amount providing from 1–5% phosphorus,
5. solid particulate organic or inorganic buffering agent which will not precipitate calcium or magnesium salts at use concentration, said buffering agent providing the necessary pH in the range of pH 7.0 – pH 8.5 and
6. any balance of said detergent consisting essentially of inert particulate filler which does not precipitate calcium or magnesium salts at use concentration.

The heart of the low pH nonionic surfactant system is the employment of a small proportion of hexametaphosphate and borax in a buffered environment having the narrow range of pH specified. Sodium bisulfate is the preferred buffer, but fumaric acid will further illustrate appropriate buffers. In the presence of borax in an amount of 15–70%, it is found that the nonionic surfactant-borax-hexametaphosphate based detergent system when buffered to the required narrow range of pH will provide good detergency while eliminating filming and spotting.

It is desired to point out that we have previously attempted to completely remove the phosphate component while still providing an effective low pH dish washing composition, and we have succeeded in doing so through the utilization of from 15–85% of borax in an appropriate composition as described in out prior copending application Ser. No. 583,908 filed June 5, 1975. However, preferred compositions in our prior application would contain from 30–75% of borax, usually about 50% of borax. This invention seeks to provide comparable results in a composition containing a reduced proportion of borax, although sacrificing the complete absence of phosphorus. Such compositions have the advantage of being more economical, and it is also possible to minimize the pH of the system down to about pH 7.0.

The hexametaphosphate component also provides some buffering agent which reduces the proportion of other buffer which is needed. A threshold effect can also be involved, a small amount of the hexametaphosphate minimizing precipitation or settling of any hard water salts which may be formed.

As a result, an effective powder detergent composition adapted for machine dish washing is provided which is capable of performing in hard water despite the use of a considerably smaller proportion of phosphorus and at much lower pH than is normally required. In the preferred compositions in this invention, sequestrants in amounts in excess of about 1% are also omitted, and this is also significant because large amounts of sequestrants add considerably to the expense of the composition. However, small amounts of a sequestrant having an affinity for iron, such as ethylene diamine tetraacetic acid, may be present in an amount up to about 1% to avoid iron staining in those communities where significant amounts of iron are present in the water supply. The expense of the composition is also reduced by the fact that less buffering agent is needed to provide the desired pH, and this means that some of the buffering agent can be replaced by less costly fillers.

It should be observed that borax is a known cleaner, but it is not normally applicable to machine dish washing because it normally provides a pH above pH 8.5 (typically pH 9.2), and at such elevated pH an undesirable film forms on dishes and glasses when hard water is used for washing. This disadvantage is sometimes countered by the use of large amounts of sequestrants. In this invention, and contra to the concepts of the prior art, filming and spotting are avoided in a nonionic system buffered for a pH in 1% water solution in the narrow range of pH 7.0 – pH 8.5.

In contrast with the knowledge of the art, when the compositions of this invention possess a pH above 8.5, then the calcium and magnesium salts in the water are precipitated and water spotting is encountered. The same difficulty arises if silicates are incorporated, and this despite the fact that the presence of silicates is usually required to avoid damaging the dishes or the machine parts. Here, silicate addition raises the pH and causes the compositions of this invention to be ineffective.

While the upper limit of pH 8.5 is critical as noted hereinbefore, the lower limit of pH is also important since, below pH 7.0, cleaning efficiency falls off and corrosion problems are encountered.

Referring more particularly to the low foaming nonionic surfactants adapted for machine dish washing, these constitute a recognized class of materials, and while specific types of nonionic surfactants and blends thereof are preferred, the entire class is useful. The nonionic surfactant may be liquid or solid, the former being preferred. These liquid products are easily absorbed on the remaining components of the composition which are primarily solids, and do not interfere with the desired dry powder characteristic because the proportion of surfactant is small.

Ethylene oxide adducts of hydrophobic organic compounds, containing from about 3 to about 30 mols of adducted ethylene oxide per mol of hydrophobic organic compound, constitute the preferred nonionic surface active agent. The hydrophobic organic compound is subject to variation in known fashion, but it usually has a hydrocarbon portion with at least 8 carbon atoms and a single reactive group, either SH or more usually OH. Polyoxypropylene can also provide a hydrophobic base, but it carries two OH groups.

As examples of nonionic surface active agents which may be used and which are formed by reacting about 3 to about 30 mols of ethylene oxide with 1 mol of hydrophobic organic compound, there may be noted the adducts of alkyl phenols with ethylene oxide, e.g., iso-octyl phenol or nonyl phenol; the adducts of the corresponding alkyl thiophenols with ethylene oxide; the ethylene oxide adducts with higher fatty alcohols of monoesters of hexahydric alcohols and inner ethers thereof such as sorbitan monoalaurate, sorbitol monooleate and mannitan monopalmitate, and the adducts of polypropylene glycols with ethylene oxide. Solid surfactants in this category are illustrated by polyoxypropylene glycol of molecular weight 1700 adducted with ethylene oxide to provide a flake product containing 80% reacted ethylene oxide to provide a molecular weight of 7500.

Further suitable nonionic surfactants are polyoxyethylene esters of organic acids, such as the higher fatty acids, resin acids, tall oil, or acids from the oxidation of petroleum, and the like. The polyglycol esters will usually contain from about 3 to about 30 moles of ethylene oxide or its equivalent and 8 to 22 carbon atoms in the acyl group of the fatty acid. Suitable products are refined tall oil condensed with 16 or 20 ethylene oxide groups, or similar polyglycol esters of lauric, stearic, oleic and like acids.

Additional suitable nonionic surfactants are the polyethylene oxide condensates with higher fatty acid amides, such as the higher fatty acid primary amides and higher fatty acid mono- and diethanol-amides. Suitable agents are coconut fatty acid amide condensed with about 10 to about 30 mole of ethylene oxide. The fatty group will contain 8 to 22 carbon atoms, usually 10 to 18 carbon atoms. The corresponding sulphonamides may also be used.

Particularly suitable polyether nonionic surfactants are the polyethylene oxide ethers of higher aliphatic alcohols. Suitable alcohols are those having from 8 to 22 carbon atoms in the molecule, preferably from 10 to 18 carbon atoms. Examples thereof are iso-octyl, nonyl, decyl, dodecyl, tridecyl, tetradecyl, hexadecyl, octadecyl and oleyl alcohols which may be condensed with from 3–30 moles, preferably from 3–6 mols, of ethylene oxide. Commercial products of this type are illustrated by BASF Wyandotte products Plurafac RA-43 and RA-435. The corresponding alkyl mercaptans or thioalcohols condensed with ethylene oxide are also suitable for use in compositions of the present invention.

As previously indicated, the nonionic surfactant is used in an amount of from 2–8% of the powder composition, preferably 3–6%.

It is particularly preferred to employ as the nonionic surfactant straight $C_1 - C_{18}$ primary alcohols which have been adducted with from 3–6 moles of ethylene oxide per mol of alcohol. This type of nonionic surfactant is particularly desirable in combination with liquid nonionic surfactants in which ethylene oxide is adducted onto a poly(oxypropylene) base, termed a hydrophobe, and having a molecular weight in the range of about 900 to about 4000. The ethylene oxide adduction is carried out to provide from about 5 to about 55% of poly(oxyethylene). These liquid products are commonly known as Pluronic polyols, and the preferred products have a hydrophobe molecular weight of from 2100 to 3600 and contain from 5–45% of poly(oxyethylene). BASF Wyandotte products Pluronic L81, L92, and L101 are preferred, but the other liquid Pluronic polyols are also useful, ranging from L31 and L35 to L121 and L122.

When these two types of nonionic surfactants are used in combination, they may be used in a weight ratio of from 1:5 to 5:1, but are preferably used in a weight ratio of 1:2 to 2:1.

The chlorine or oxygen-supplying bleaching agent is entirely conventional, it being customary to employ such agents in dish washing compositions. The chlorine bleaching agents are more usual, these being illustrated by chlorinated trisodium phosphate, trichlorocyanuric acid, the sodium or potassium salt of dichlorocyanuric acid, and dichlorodimethylhydantoin. Inorganic hypochlorites such as lithium, potassium, and magnesium hypochlorites are also useful. The oxygen supplying bleaching agents which may be used are also conventional, such as alkali metal persulfates, percarbonates, perborates, and the like, typically illustrated by sodium perborate.

The term "borax" is intended to identify alkali metal (primarily sodium) borate hydrates, typically the decahydrate. These borates have the formula $Na_2B_4O_7.xH_2O$, in which $x$ is a number identifying the amount of bound water. When proportions are given herein for borax, it will be understood that while one is not restricted to the decahydrate, it is the decahydrate which is normally used, and it is the decahydrate which is used as the basis for calculation. Borate proportions of from 15–70% are contemplated, the preferred borate proportion being from 20–60%. 30% of the borate component will be used as illustrative. In this invention, the presence of hexametaphosphate permits 30% borax to provide about the same detergency as 50% borax in our said prior application.

Sodium hexametaphosphate is preferred, but other alkali metals, such as potassium may be used instead. Other phosphates are not equivalent to the hexametaphosphate and do not provide a good detergent in the low pH environment. The hexametaphosphate content is defined by the presence of 1–5%, preferably 2–4% phosphorus in the composition, 2.9% phosphorus being illustrative.

As previously indicated, solid particulate organic or inorganic buffering agents which will not precipitate calcium or magnesium salts at use concentration are employed to lower the pH into the range of pH 7.0 to pH 8.5. Sodium bisulfate is particularly preferred and will be used in the examples which are presented hereinafter.

The inert particulate filler is subject to wide variation and any solid organic or inorganic agent may be used so long as it does not precipitate calcium or magnesium salts. Sodium sulfate and potassium chloride are suitable. The filler is normally present in an amount of at least 25% of the composition.

Other inert fillers are illustrated by urea and sodium chloride, though urea is more costly.

Various materials may optionally be present, and some of these are noted below.

Anionic surfactants, such as dodecyl hydrogen phosphate, methyl naphthalene sulfonate, sodium-2-acetamido-hexadecane-1-sulfonate, and the like, may be included in amounts up to about 2%, but the essential surfactant in this invention must be nonionic.

Enzymes are a desirable adjunct when it is desired to maximize the capacity to solubilize proteins. In such instance, the chlorine bleach should be avoided, and an oxygen bleach used in its place. The low pH which characterizes the compositions proposed herein eases the burden of incorporating enzymes.

Various other auxiliary agents may be present up to a total of about 5%, preferably up to about 1%. These are illustrated by perfumes, flow control agents, colorants, moisture absorbents, carriers for the nonionic surfactant (if liquid) antifoam agents, and the like.

In this specification, examples, and claims, all proportions are by weight unless otherwise specified.

The invention is illustrated in the example which follows.

EXAMPLES OF BUFFERED HEXAMETAPHOSPHATE-CONTAINING BORAX-BASED MACHINE DISHWASH DETERGENT

| | A | B | C | D | E | F |
|---|---|---|---|---|---|---|
| Sodium Tetraborate Decahydrate | 30.0 | 30.0 | 30.0 | — | 30.0 | |
| Sodium Tetraborate Pentahydrate | — | — | — | 25.0 | — | 25.0 |
| Sodium Hexametaphosphate | 2.9%P | 2.9%P | 2.9%P | 2.9%P | 2.9%P | 2.9%P |
| Sodium Bisulfate | 5 | 5 | 15 | 5 | 10 | 5 |
| Sodium Sulfate | Bal | Bal | Bal | Bal | — | Bal |
| Potassium Chloride | — | — | — | — | Bal | — |
| Nonionic Surfactant[1] | 4.0 | 4.0 | 2.0 | 4.0 | 2.0 | 4.0 |
| Other Surfactant | — | — | 2.0[2] | — | 2.0[3] | — |
| Chlorine Release Agent[4] | 1.0%$Cl_2$ | — | — | — | — | — |
| Sodium Perborate monohydrate (16% oxygen) | — | 10.0 | — | — | — | 10.0 |
| Protease Enzyme | — | — | — | — | — | 1.0 |

[1]A 6 mol ethoxylate of straight chain n-dodecyl alcohol (BASF Wyandotte product Plurafac RA-43 may be used).
[2]Poly(oxypropylene) hydrophobe of molecular weight 1200 adducted with ethylene oxide to provide 40% poly(oxyethylene). BASF Wyandotte product Pluronic L-44 may be used.
[3]A 3 mol ethoxylate of n-dodecyl alcohol.
[4]Potassium salt of dichlorocyanuric acid.

All of the above examples provided powdered detergent compositions, which were effective machine dish washing detergents which could be used in hard water.

We claim:

1. A powder detergent composition adapted for machine dish washing using hard water and which does not require the presence of large amounts of phosphates consisting essentially of the following components by weight:

1. from 2–8% of low foaming nonionic surfactant useful for machine dish washing,
2. from 0.5–5% of available chlorine or oxygen from a bleaching agent,
3. from 15–70% of borax,
4. alkali metal hexametaphosphate in an amount providing from 1–5% phosphorus,
5. solid particulate organic or inorganic buffering agent which will not precipitate calcium or magnesium salts at use concentration, said buffering agent providing a pH in the range of pH 7.0 – pH 8.5 when the composition is placed in 1% water solution, and
6. any balance of said detergent consisting essentially of inert particulate filler which does not precipitate calcium or magnesium salts at use concentration.

2. A powder detergent composition as recited in claim 1 in which said buffering agent supplies a pH of at least pH 7.8 when the composition is placed in 1% water solution.

3. A powder detergent composition as recited in claim 1 in which said composition is free of sequestrants other than those having an affinity for iron in an amount up to about 1%.

4. A powder detergent composition as recited in claim 1 in which said borax is present in an amount of from 20–60%.

5. A powder detergent composition as recited in claim 1 in which said borax is present as a pentahydrate.

6. A powder detergent composition as recited in claim 1 in which said borax is present as a decahydrate.

7. A powder detergent composition as recited in claim 1 in which inert particulate filler is present in an amount of at least 25%.

8. A powder detergent composition as recited in claim 1 in which said nonionic surfactant consists of ethylene oxide adduct of hydrophobic organic compound, the adduct containing from about 3 to about 30 moles of adducted ethylene oxide per mol of said compound.

9. A powder detergent composition as recited in claim 1 in which at least a portion of said nonionic surfactant is an ethylene oxide adduct of a nonohydric alcohol containing from 8–22 carbon atoms.

10. A powder detergent composition as recited in claim 1 in which said nonionic surfactant is used in an amount of from 3–6%.

11. A powder detergent composition as recited in claim 1 in which said bleaching agent supplies active chlorine.

12. A powder detergent composition as recited in claim 1 in which sodium hexametaphosphate is used.

13. A powder detergent composition as recited in claim 3 in which said sequestrant is ethylene diamine tetraacetic acid.

14. A powder detergent composition as recited in claim 7 in which at least 25% of the composition is sodium sulfate.

15. A powder detergent composition as recited in claim 9 in which said nonionic surfactant contains from 3–6 moles of ethylene oxide per mol of $C_8 - C_{18}$ primary straight chain alcohol.

16. A powder detergent composition as recited in claim 12 in which the proportion of hexametaphosphate supplies from 2–4% phosphorus.

17. A powder detergent composition as recited in claim 15 in which a further portion of said nonionic surfactant is a liquid in which ethylene oxide is adducted onto a poly(oxypropylene) hydrophobe having a molecular weight in the range of about 900 to about 4000, the adduct containing from about 5 to about 55% of poly(oxyethylene), the two types of nonionic surfactants being used in a weight ratio of from 1:5 to 5:1.

18. A powder detergent composition as recited in claim 17 in which said poly(oxypropylene) hydrophobe has a molecular weight of from 2100 – 3600.

* * * * *